US006840254B1

(12) United States Patent
Windham

(10) Patent No.: US 6,840,254 B1
(45) Date of Patent: Jan. 11, 2005

(54) PORTABLE DRESSING BLIND AND METHOD OF USE

(76) Inventor: William Edward Windham, 4031 Bibb La., Orlando, FL (US) 32817

( * ) Notice: Subject to any disclaimer, the term of this patent is extended or adjusted under 35 U.S.C. 154(b) by 0 days.

(21) Appl. No.: 10/687,330

(22) Filed: Oct. 16, 2003

(51) Int. Cl.[7] ..... E04H 15/32

(52) U.S. Cl. ..... 135/905; 135/902; 135/117; 135/90

(58) Field of Search ..... 135/901–902, 135/905, 115, 117, 90, 157, 87; 43/1; 160/330, 351

(56) References Cited

U.S. PATENT DOCUMENTS

| | | | | |
|---|---|---|---|---|
| 1,288,518 A | | 12/1918 | Collier | |
| 1,376,218 A | * | 4/1921 | Morant | 135/90 |
| 1,409,316 A | | 3/1922 | Smith | |
| 1,466,166 A | | 8/1923 | Hodgson | |
| 1,713,439 A | | 5/1929 | Klyaich | |
| 1,804,190 A | | 5/1931 | Wendel | |
| 2,027,551 A | | 1/1936 | Rideout | |
| 2,167,861 A | | 8/1939 | Baruch | |
| 2,221,366 A | | 11/1940 | Bisbing et al. | |
| 2,594,410 A | | 5/1952 | Feldpausch | |
| 2,652,845 A | | 9/1953 | O'Neill et al. | |
| 2,770,214 A | * | 11/1956 | Ryckman | 118/242 |
| 2,847,017 A | * | 8/1958 | Drago | 135/157 |
| 2,926,677 A | | 3/1960 | Lalonde | |
| 3,397,710 A | * | 8/1968 | Mcelroy | 135/121 |
| 3,709,237 A | * | 1/1973 | Smith | 135/901 |
| 4,449,542 A | | 5/1984 | McSwain et al. | |
| 5,430,980 A | | 7/1995 | Ferrier | |
| 5,592,961 A | | 1/1997 | Chin | |
| 5,836,330 A | * | 11/1998 | Franklin | 135/90 |
| 6,148,836 A | * | 11/2000 | Cananzey | 135/90 |
| 6,434,877 B1 | | 8/2002 | Shelton | |

FOREIGN PATENT DOCUMENTS

| | | | |
|---|---|---|---|
| JP | 10-238169 | * | 9/1998 |
| JP | 11-210267 | * | 8/1999 |

* cited by examiner

*Primary Examiner*—Winnie Yip
(74) *Attorney, Agent, or Firm*—John V. Stewart

(57) ABSTRACT

An enclosure of fabric with four vertical sides that is open at the top and bottom. A continuous sheath is sewn around the top edges of three sides. Three rods are inserted into the sheath from one end. The rods are not held to each other except by the sheath. A support person stands in front of the blind and holds the first and third rods apart and parallel to each other. The rods hang three respective sides of the blind directly. The fourth side hangs from the tension span between the two ends of the rod sequence. The fourth side has a flap at the bottom. The support person stands on this flap with his or her back to the wind. This prevents billowing and raising of the blind by the wind. An occupant can enter this blind before or after it is raised by the support person.

4 Claims, 3 Drawing Sheets

PORTABLE DRESSING BLIND AND METHOD OF USE

BACKGROUND OF THE INVENTION

1. Field of the Invention

This invention relates to portable folding dressing blinds for changing clothes at a beach or other site that lacks convenient private facilities.

2. Description of Prior Art

Prior patents show numerous portable clothes changing blinds made of fabric for beach-goers. These range from tents to a curtain enclosure that hangs from an umbrella-like hat worn by the occupant. Tents are time-consuming to erect and fold. They require assembly of frame elements, and they often require one or more support poles and/or stakes to be hammered into the ground. On the other extreme, a curtain that hangs from the head or shoulders of an occupant prevents the occupant from changing any article of clothing that goes over the head, such as a shirt, blouse, or some dresses.

Windy conditions are normal on beaches, and many prior designs provide for winds. Provisions include stakes for the lower edges of the fabric and/or pockets for ballast such as sand. Stakes are time-consuming and inconvenient to install. They are easily lost or left behind. Short stakes are not effective in loose sand, but long stakes are bulky. Sand ballast is time-consuming to scoop and pour into pockets for each set-up, and to pour out for each folding. However, if the ballast is permanent, then the folded blind is heavy and bulky.

The fabric of a portable blind can become soiled from lying on the ground, from spillage of drinks in a car trunk, etc. It should therefore be easy to clean. Any fabric that has sewn-in frame elements or permanent ballast cannot be washed in a washing machine. Elements such as metal grommets, ties, and temporary sand ballast in pockets can make washing more difficult.

For these and other reasons, none of the prior devices provide a combination of fast, convenient set-up and folding; a small, light folded form; stability in wind; easily washable fabric; and a blind that can be used for all clothes changing.

SUMMARY OF THE INVENTION

The object of the invention is provision of a portable clothes changing blind that is very compact when folded; requires no significant set-up time; is wind resistant; machine washable; and has no hinges, ropes, support poles, weights, ties, grommets, or stakes.

The above objects are all achieved in a clothes changing blind that is held up by a second person for an occupant in the blind. The blind is a fabric enclosure that is open at the top and bottom, and has four sides. A continuous sheath is sewn around the top edges of three sides. Three straight rods are inserted into the sheath from one end. The rods are not held to each other except by the sheath. A support person stands in front of the blind and holds up the first and third rods, apart and parallel to each other. Three sides of the blind hang from the three respective rods. The fourth side hangs between the first and third rods by tension. The fourth side has a flap at the bottom. The support person stands on this flap with his or her back to the wind. This prevents billowing and raising of the blind by the wind.

REFERENCE NUMBERS

Figure 1:
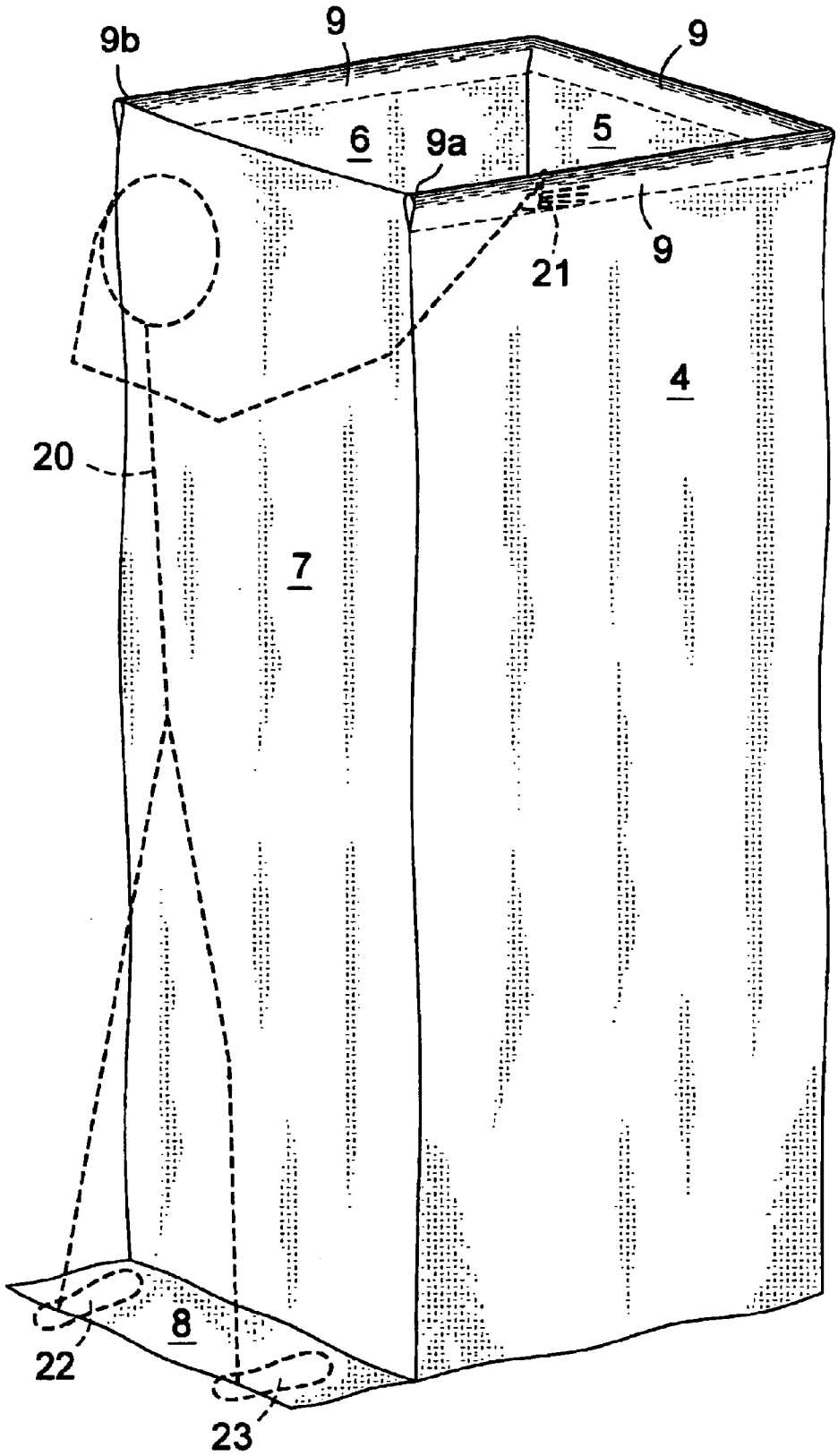
FIG. 1 is a front upper perspective view of the invention in use, with a support person indicated as a stick figure in dashed lines.
Figure 2:
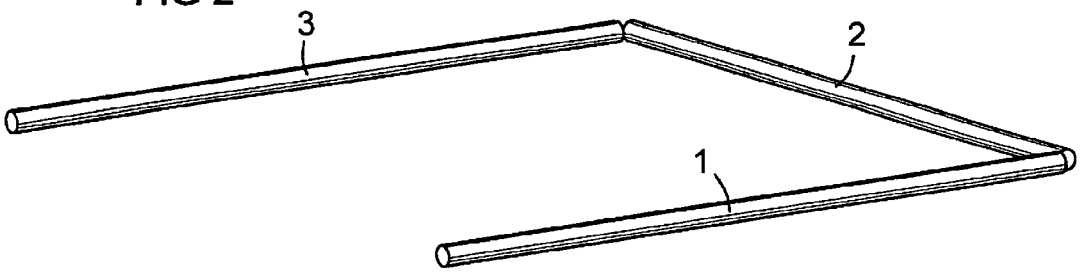
FIG. 2 is a perspective view of three rods as they are positioned in the sleeve 9 of FIG. 1—not connected to each other except by the sleeve.
Figure 3:
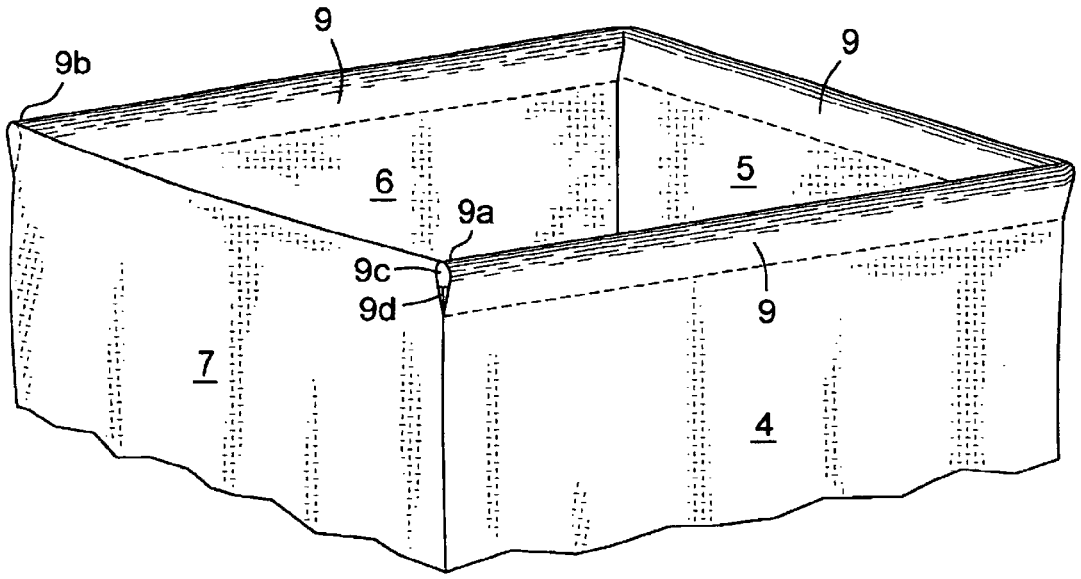
FIG. 3 is an enlarged perspective view of a top portion of FIG. 1.
Figure 4:
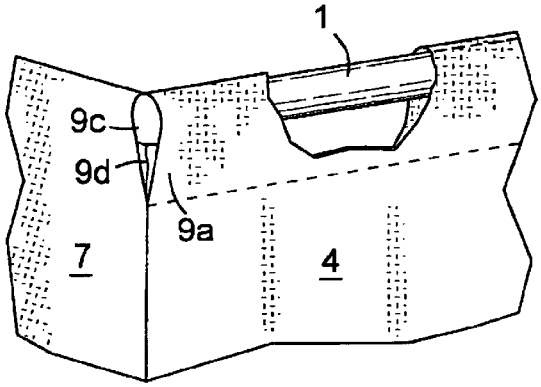
FIG. 4 is an enlarged, partially cut-away, perspective view of an end 9*a* of the sleeve 9.
Figure 5:
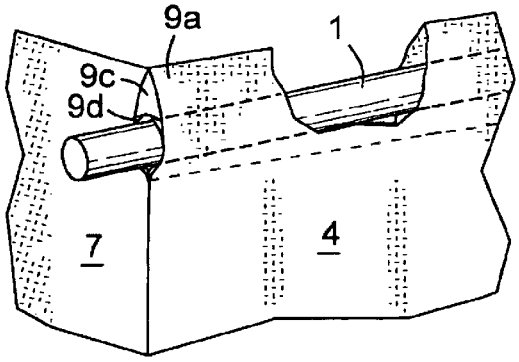
FIG. 5 is a view as in FIG. 4 showing insertion or removal of a rod from the end of the sleeve.
Figure 6:
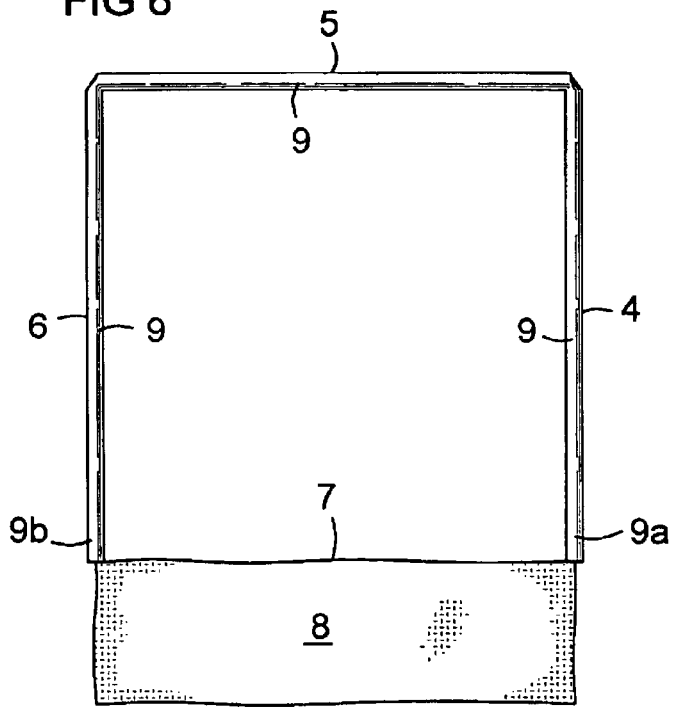
FIG. 6 is a top view of FIG. 1, less the human figure.

1. First rod
2. Second rod
3. Third rod
4. First side
5. Second side
6. Third side
7. Fourth side
8. Foot flap
9. Sleeve or sheath
9*a*. First end of sleeve
9*b*. Second end of sleeve
9*c*. Upper closed part or retaining web of sleeve end
9*d*. Lower entry part of sleeve end
20. Support person
21. Hand of support person
22. Left foot of support person
23. Right foot of support person

DETAILED DESCRIPTION

The invention is a blind for changing clothes on the beach. It is made of a flexible opaque or light-diffusing material, preferably fabric. The fabric is sewn into a generally square or rectangular tube with an open top and bottom. A continuous sleeve is sewn into the top edge of the fabric around three sides 4, 5, and 6. Three generally rigid rods 1, 2, and 3 are inserted in the sleeve, forming three rigid edges at the top, from which the tube hangs as a closed curtain. The top of the fourth side 7 is suspended between the ends 9*a* and 9*b* of the sleeve, which are supported by rods 1 and 3 respectively. A foot flap 8 extends from the bottom of side 7.

In operation, a support person stands on the foot flap 8 in a wide stance, and holds rods 1 and 3 parallel to each other at head height with enough lateral force to suspend the fourth side 7 between them. This forms a horizontal U-shaped temporary frame of rods, on which the curtain hangs in the shape of a generally square or rectangular tube. A user steps inside this tube before or after it is raised, and changes clothes. The foot flap prevents billowing and raising of the fabric in a wind.

Figure 7:
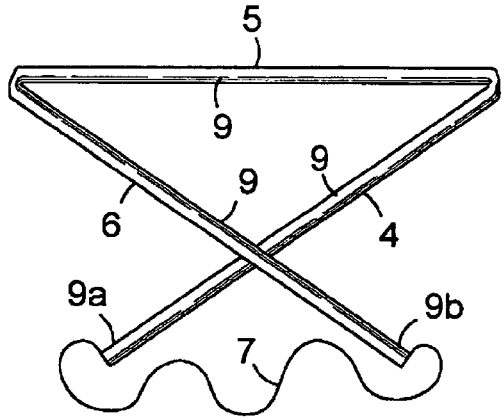
FIG. 7 is a top view as in FIG. 6 in a partially folded position.
Figure 8:
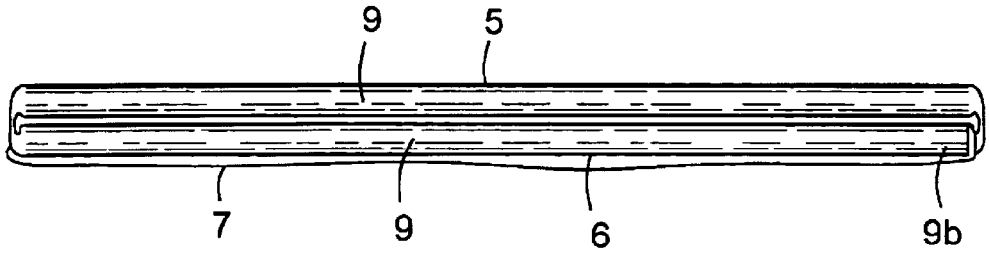
FIG. 8 is an enlarged top view in a folded state, not showing fabric that hangs below the viewed portion or is rolled around it. The top of side 4 is nested under the top of side 6 and is hidden.

The rods are preferably not attached to each other, so they are easily folded and nested against each other. FIG. 7 shows rods 1 and 3 rotated inward against rod 2. Rod 1 is nested below rod 3, so it is not visible. The fabric sides and the foot flap extend away from the viewpoint in FIG. 7, and are not shown. They are wrapped around the folded rods to form a compact roll that is only the length of a rod. Alternately rods 1 and 3 can be rotated to opposite sides of rod 2, folding in a collapsed "Z" form. Optionally, the rods can be connected end-to-end in sequence with cord attached between adjacent ends of the rods.

The sheath 9 can be open at one or both ends 9*a* and 9*b*. Preferably, the opening is provided with a retaining web 9*c* that blocks the rod from sliding out of the sheath. This web preferably covers approximately the upper half of the opening. The lower half of the opening has an access slot 9*d*. The rods are easily inserted and removed from this slot, but will not slide out accidentally. This design eliminates, buttons, snaps, Velcro, and the like, which take more time to use, are subject to damage, and are more expensive to produce.

Another option is to close the end of the sheath completely, and provide an access slot about 1 inch from the end of the sheath. The rod can be inserted and removed from this slot, but will not slide out accidentally. However, this is less convenient to use than the preferred design shown.

As an example of a preferred size and construction, the prototype uses ½" PVC pipe for the rods, each rod is about 30 inches long, and the fabric enclosure is about 72 inches tall. The foot flap is about 8 inches long. The prototype weighs only about 2.5 lbs., and is fully satisfactory.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

One example of such a modification is an enclosure as shown, but using only two rods, 1 and 3. The sheath can be continuous as shown, or separate for each rod. In this embodiment, both the front panel 7 and back panel 9 of the enclosure hang between rods 1 and 3 by tension. This configuration is less stable than the preferred embodiment using three rods, and is harder for the support person to hold in shape, so it is not preferred. As another example of a modification, a three-sided enclosure with only two rods could be used. However, this is much less roomy than a four-sided enclosure, and is not preferred.

I claim:

1. A method of using a portable dressing blind, comprising the steps of;

a) providing a tube of flexible material with first and second open ends;

b) providing a sheath around at least part of the first end of the tube;

c) providing a flap of flexible material on part of the second end of the tube;

d) providing a plurality of rods including a first and last rod;

e) inserting the rods in the sheath such that the first and last rods are on opposite sides of the opening of the first end of the tube;

f) a person standing on the flap and manually gripping the sheath to hold the first and last rods up, apart, and approximately parallel, thus holding the tube of flexible material in a vertical orientation with the first end of the tube at the top and the second end held down by the flap.

2. A method of using a portable dressing blind, comprising the steps of:

a) providing an enclosure of flexible material having first, second, third, and fourth generally vertical sides, each side having a top edge and bottom edge, the top edges defining a top of the enclosure, the bottom edges defining a bottom of the enclosure;

b) providing a continuous sheath along the top edges of the first, second, and third sides, the sheath having first and second ends, at least one of said ends having an opening, the fourth side of the enclosure having a flap extending at least 6 inches from the bottom edge;

c) providing a first generally rigid rod having approximately the length of the first top edge and inserted in the of sheath along the first top edge;

d) providing a second generally rigid rod having approximately the length of the second top edge and inserted in the sheath along the second top edge; a e) providing a third generally rigid rod having approximately the length of the third top edge and inserted in the sheath along the third top edge; and f) a person standing on the flap; manually gripping the sheath; and holding the first and third rods up, apart and approximately parallel, thus holding the enclosure of flexible material in a vertical orientation with the bottom of the enclosure held down by the flap.

3. The method of claim 2 wherein said opening in at least one end of the sleeve sheath is vertically elongated, and comprises an upper closed part and a lower entry part.

4. A method of using a portable dressing blind comprising the steps of:

a) providing an enclosure of fabric with first, second, third, and fourth vertical sides, each side having a width, a top edge, and a bottom edge;

b) providing a continuous sheath sewn around the top edges of the first, second, and third sides;

c) providing first, second, and third rods inserted into the sheath end-to-end, each rod extending across approximately the width of the respective first, second, and third sides;

d) providing a flap of fabric extending at least 6 inches from the bottom edge of the fourth side;

e) providing no vertical support pole; and f) a person standing on the flap; manually gripping the sheath; and holding the first and third rods up, apart, and approximately parallel, thus holding the enclosure of flexible material in a vertical orientation with the bottom of the enclosure held down by the flap.

* * * * *